US010000085B2

(12) United States Patent
Neuhaus

(10) Patent No.: US 10,000,085 B2
(45) Date of Patent: Jun. 19, 2018

(54) DEVICE AND METHOD FOR TRANSFERRING FLOWABLE PRINTING SUBSTANCES ONTO A PRINTING MATERIAL

(71) Applicant: Dietmar Neuhaus, Dusseldorf (DE)

(72) Inventor: Dietmar Neuhaus, Dusseldorf (DE)

( * ) Notice: Subject to any disclaimer, the term of this patent is extended or adjusted under 35 U.S.C. 154(b) by 0 days. days.

(21) Appl. No.: 15/023,117

(22) PCT Filed: Sep. 5, 2014

(86) PCT No.: PCT/EP2014/068936
§ 371 (c)(1),
(2) Date: Mar. 18, 2016

(87) PCT Pub. No.: WO2015/039892
PCT Pub. Date: Mar. 26, 2015

(65) Prior Publication Data

US 2016/0229213 A1 Aug. 11, 2016

(30) Foreign Application Priority Data

Sep. 20, 2013 (DE) ..... 10 2013 218 961

(51) Int. Cl.
*B41N 1/06* (2006.01)
*B41M 1/10* (2006.01)
*B41M 1/00* (2006.01)

(52) U.S. Cl.
CPC ..... *B41N 1/06* (2013.01); *B41M 1/10* (2013.01); *B41M 1/00* (2013.01)

(58) Field of Classification Search
CPC ..... B41F 31/08; B41M 1/06; B41M 1/00; B41M 1/10
See application file for complete search history.

(56) References Cited

U.S. PATENT DOCUMENTS 4,729,310 A * 3/1988 Love, III ..... B41C 1/055 101/157
4,797,693 A * 1/1989 Quate ..... B41J 2/14008 347/43

(Continued)

FOREIGN PATENT DOCUMENTS

DE 3705988 A1 10/1988
DE 19746174 C1 7/1999

(Continued)

OTHER PUBLICATIONS

Aydar et al. "Determination and modeling of contact angle of Canola oil and olive oil on a PTFE surface at elevated temperatures using air or steam as surrounding media" LWT—Food Science and Technology 65 (2016) p. 304-310.*

*Primary Examiner* — Jennifer Simmons
(74) *Attorney, Agent, or Firm* — The Webb Law Firm

(57) ABSTRACT

A printer's form for transferring a flowable printing substance onto a printing material to be printed on includes a body having a surface, which surface has a plurality of openings, a plurality of cavities in the body, which cavities end in the openings of the surface of the body and contain gas, wherein each cavity is bounded by a wall, which adjoins the opening and surrounds the cavity, and devices associated with each cavity for producing an overpressure in the cavity in question. At least parts of the surface of the body and/or the wall surfaces of the walls of at least some cavities include a first wall region, which is near the opening and which is composed of a surface that can be wetted with the printing substance.

11 Claims, 6 Drawing Sheets

(56) References Cited

U.S. PATENT DOCUMENTS

| | | | | |
|---|---|---|---|---|
| 5,671,678 | A * | 9/1997 | Bolte | B05C 1/0808 101/491 |
| 2002/0000190 | A1 | 1/2002 | Neuhaus | |
| 2011/0023740 | A1* | 2/2011 | Ray | B41M 1/06 101/453 |
| 2012/0103218 | A1* | 5/2012 | Stowe | B41F 7/00 101/450.1 |

FOREIGN PATENT DOCUMENTS

| | | | |
|---|---|---|---|
| DE | 19718906 | A1 | 9/1999 |
| DE | 10213012 | A1 | 2/2003 |
| WO | 0040423 | A1 | 7/2000 |

* cited by examiner

DEVICE AND METHOD FOR TRANSFERRING FLOWABLE PRINTING SUBSTANCES ONTO A PRINTING MATERIAL

CROSS-REFERENCE TO RELATED APPLICATIONS

This application is the United States national phase of International Application No. PCT/EP2014/068936 filed Sep. 5, 2014, and claims priority to German Application No. 10 2013 218 961.3 filed Sep. 20, 2013, the disclosures of which are hereby incorporated in their entirety by reference.

BACKGROUND OF THE INVENTION

Field of the Invention

The invention relates to a device and a method for transferring flowable printing substances, in particular flowable printing inks, onto a printing material.

Description of Related Art

Printing methods exist, in which liquid printing ink is transferred onto a printing material by contact between a printing plate and said material. In these known methods the patterns to be printed are provided on the printing plate. The patterns may be provided on a surface as depressions and raised parts. Printing ink is applied on the raised parts (relief printing) or pressed into the depressions (gravure printing) and is transferred onto the printing material by contact with the printing material. The methods mentioned have the disadvantage that every new pattern to be printed requires a new printing plate.

From EP 1154905 a printing method is known for printing on printing materials with printing inks, in which different patterns can be printed using only a single printing plate.

For this purpose, a printing plate is used whose surface is formed with a raster of small openings with adjoining cavities. The small openings form the raster dots from which a pattern to be printed can be built. In a variant of the known printing method, the printing ink is sucked through the openings into the cavities by means of a vacuum in the cavities. An overpressure is generated thereafter in selected cavities, whereby the printing ink is applied onto the printing material through the openings of the respective cavities. The known printing method may also provide that printing ink is sucked only into selected cavities.

The known printing method is relatively complicated, since on the one hand the printing ink must not enter into the opening of the printing plate by itself, and on the other hand, however, the pressure difference generated in the cavity, which is caused for example by heating and cooling the gas filling in the cavity, must be sufficient to draw printing inks into the openings. This can only be achieved if the surface properties of the printing plate and the printing ink are exactly matched to each other. In addition, the process of generating a vacuum in a cavity and of covering the associated opening with printing ink must be synchronized very precisely with respect to time. These requirements make this printing method prone to failure.

SUMMARY OF THE INVENTION

It is an object of the present invention to provide a printing plate and a simplified method for printing on printing materials, in which different patterns are printed using only a single printing plate.

A printing plate for transferring a flowable printing substance onto a printing material to be printed on, includes a body having a surface, which surface has a plurality of openings, a plurality of cavities in the body, which end in the openings of the surface of the body and contain gas, wherein each cavity is bounded by a wall which adjoins a respective opening and surrounds the cavity, and devices associated with each cavity for producing an overpressure in the cavity in question, it is provided that at least parts of the surface of the body and/or of the wall surfaces of the walls of at least some, preferably all cavities include or consist of a first wall region, which is near the opening and which is composed of a surface that can be wetted with the printing substance.

Due to a design of the surface of the body and/or of the wall surfaces of some cavities, a printing plate of the present invention makes it possible to close the openings in the surface of the body in a gas-tight manner with the flowable printing substance. Thereby, it is possible by application of overpressure in a cavity to press the portion of the printing substance which closes the opening onto the printing material to be printed on. According to another embodiment, in which the wall surfaces of the cavities include or consist of a wettable surface in the wall region near the opening, capillary forces draw the printing substance at least in part into the cavities via the openings. In another embodiment, in which the surface of the body is formed by a surface wettable with the printing substance, so that the printing substance is applied onto the surface of the body and wets the same, a distance should be kept between the surface of the printing plate and the printing material to be printed on, in order to prevent the printing substance from being applied onto the printing material without overpressure in the corresponding cavities. If the printing plate is designed such that the printing substance is drawn into the cavities, such a distance is not required provided that excess printing ink is stripped off the printing plate for example by means of a doctor blade.

A printing plate of the present invention has an advantage that the printing substance remains on the printing plate and/or in the cavities without any interference from outside and closes the openings of the cavities in a gas-tight manner. Thus, it is not necessary to adjust the pressure in the cavities already upon application of the printing substance, whereby the printing plate becomes more robust and less failure-prone during printing on printing materials.

Preferably it is provided that, with the printing substance applied on the printing plate, the contact angle between the printing substance and the surface of the body or between the printing substance and the wall surface in the first wall region is <90°, preferably <45°. Thereby, a particularly advantageous wetting of the corresponding surfaces is guaranteed.

In one embodiment of a present invention printing, plate the device for generating an overpressure in a cavity comprises at least one deformable and/or mobile wall region for the purpose of varying the volume of the cavity, wherein the volume of the cavity may be reduced by deforming and/or moving the wall region. Thus, the overpressure can be generated in the cavity in an advantageous manner. In this regard, it may be provided that the deformable and/or mobile wall region of the cavity is pre-tensioned to a first position and may be moved to a second position by means of an actuator, the volume of the cavity being smaller in the first position of the wall element than in the second position. Thus, the overpressure can be generated in a simple manner by releasing the actuator when the wall region has been moved to the second position and by returning the wall region to the first position due to the pre-tensioning. Here, the force required to generate the overpressure is provided by the pre-tensioning.

In a particularly preferred embodiment, it is provided that the device for generating overpressure in a cavity comprises a heating device for heating the gas in the cavity. In this manner it is possible, with little effort regarding device technology, to achieve that an overpressure is generated in a cavity by heating the gas using the heating device. Since the opening of the cavity is closed in a gas-tight manner by the printing substance during the printing operation, heating the gas causes the pressure in the cavity to rise until it is sufficient to force the printing substance from the opening of the cavity.

In this regard, it may be provided that the heating device for heating the gas in the cavity is designed as a resistance heating element. As another embodiment it may be provided that the heating device for heating the gas in the cavity is designed as a heating element heating up by absorbing electromagnetic radiation. The heating element preferably comprises a metal oxide. Laser light is preferably used as the electromagnetic radiation. With such a design of the heating device, the gas in the cavity can be heated in a particularly simple manner and very quickly, while at the same time individual cavities can be controlled very specifically. By heating the gas quickly, it is achieved that the printing substance that closes the opening of the cavity in a gas-tight manner is not only expelled from the opening or forced away from the opening, but, due to a rapid increase in gas pressure caused by heating the gas, the printing substance is accelerated and is flung onto the printing material in an advantageous manner. Thus, a particularly advantageous printing becomes possible, wherein in particular if the present invention printing plate is designed such that the surface of the body is arranged at a distance from the printing material, this distance can be overcome in an advantageous manner.

According to one embodiment, it is provided that, in a second wall region remote from the opening, the wall surfaces of the walls of at least some, preferably all cavities include or consist of a surface that is poorly or not at all wettable with the printing substance. Here, the second wall region preferably adjoins the first wall region.

According to one embodiment, in which only the first wall region includes or consists of a surface well wettable with the printing substance, the printing substance enters deep into the cavity until the counter pressure caused by the gas in the cavity is sufficient to prevent a further intrusion of printing substance. By providing a second wall region having surface poorly or not at all wettable with the printing substance, a barrier is formed against a deeper intrusion of printing substance. The surface poorly or not at all wettable forms a contact angle with the printing material that is larger than 90°.

The gas provided in the cavity may be air, for example.

According to an embodiment, it is provided that protrusions are arranged on the surface to serve as spacers with respect to the printing materials. In particular in an embodiment of the invention in which the surface of the body is formed by a well wettable surface, it is thereby prevented that the printing material can come into contact with the surface wetted with the printing substance.

The protrusions on the surface may be formed by the roughness of the surface.

When using a printing plate with protrusions, care may be taken to wet the surface only so far with printing substance that the tips of the protrusions are not covered with printing substance so that it is prevented that printing substance gets onto the printing material in an uncontrolled manner.

In a particularly preferred embodiment, it is provided that the maximum diameter of the openings is smaller than the capillary length of the printing substance. In this manner, the influence of gravity on the behavior of the printing substance in the openings of the printing plate becomes negligible. The maximum diameter is understood to be the maximum distance between two directly opposite points on the opening edge, where the opening may also have a shape different from a circular shape. The capillary length is equal to the square root from the surface tension of the printing substance as the quotient divided by the product from the density of the printing substance and gravitational acceleration. For example, for a printing substance having the surface tension and the density of water, the capillary length is about 2.7 mm.

The gas in a cavity may also be heated by direct inductive, capacitive or resistive coupling of energy into the gas or by absorption of electromagnetic radiation by the gas.

In an embodiment, it is provided that the device for generating overpressure can generate different overpressures for expelling different quantities of printing substance.

A printing plate may further comprise a cooling device by which the cavities can be cooled to ambient temperature.

A method for transferring a flowable printing substance from a printing plate onto a printing material provides that capillary forces draw the printing substance into cavities into which the openings in the printing plate surface open, wherein the pressure substance is located in the openings and in the region of the cavities that is near the opening and/or the printing substance wets the surfaces, wherein the printing substance closes at least some of the openings in a gas-tight manner, and that the printing substance is expelled from the cavities onto the printing material by applying overpressure, wherein a printing plate according to an embodiment of the invention may be used.

A method of the present invention may provide that the printing substance is drawn into the openings and the regions of all cavities of a group of cavities, which regions are close to the openings, and/or that the printing substance closes the openings of all cavities of a group of cavities in a gas-tight manner, and that the discharge is realized by selectively applying overpressure in selected cavities of this group of cavities.

Of course it may also be provided that an overpressure is generated in all cavities of this group.

A method of the present invention may thus use a printing plate according to the present invention whose surface is provided with a raster of small openings from which the printed image is composed. Each of the openings opens into a cavity arranged behind the opening, which can be heated or cooled by an appropriate device. Each cavity has only one opening. A flowable printing substance is applied onto the surface of the printing plate by suitable devices in order to close the openings in the surface of the printing plate in a gas-tight manner with the printing substance and to thereby trap a volume of gas in the associated cavities. The printing substance may be applied on the printing plate by spreading, spraying or by immersion into the printing substance. In this process, the temperature of the gas filling in the cavities is referred to as the initial temperature. Thereafter, the printing substance is transferred from the printing plate onto the printing material by heating individual cavities, and thus the gas fillings in these cavities, corresponding to the printed image. Thereby, the temperature of these gas fillings rises relative to the initial temperature, as does the gas pressure thereof relative to the ambient pressure. By means of a sufficiently strong and quick heating of these gas fillings and of the resulting increase in pressure in these gas fillings, printing substance is forced away from the openings associated with these cavities, accelerated and flung onto the printing material assisted by the gas flows from these cavities. Thereafter, the heated cavities are cooled and are thus returned to the initial temperature. Here, the openings are free and an exchange of gas can occur between these cavities and the environment.

A cycle of the printing method may be performed again, which cycle comprises the sealing of the openings with the printing substance in a gas-tight manner, the quick heating of gas fillings in selected cavities corresponding to the patterns to be printed, the resulting acceleration, flinging out and transfer of pressure substance on the printing material, the subsequent cooling of gas fillings including the gas exchange between the cavities and the environment.

When transferring printing substance from the printing plate onto the printing material it is advantageous if the distance between the printing plate and the printing material is as small as possible, so that an optimum resolution predetermined by the arrangement of the openings in the surface of the printing plate can also be achieved in the printed image on the printing material. Larger distances between the printing plate and the printing material cause an expansion of the application area of the printing substance applied onto the printing material, whereby the resolution is reduced in the printed image. An optimum resolution of the printed image is achieved if the printing material contacts the printing plate as the printing substance is transferred. This is possible if the printing substance enters into the openings of the printing plate, but no printing substance remains on the surface of the printing plate. This can be achieved for example by wiping excess printing substance from the printing plate with a doctor blade after the printing substance has been applied onto the printing plate. Advantageously, the printing substance enters into the openings of the printing plate only to some extent, since the cavity behind the openings should not be filled completely with printing substance, because a residual gas volume may be used for the printing method. This may be assisted by the fact that, immediately behind an opening in the printing plate, the inner wall of the cavity is designed such that it is wetted well by the printing substance, whereby capillary forces draw the printing substance into the opening.

Beyond a predetermined intrusion depth, however, the inner wall of the cavity is designed such that the wettability is significantly worse, whereby a barrier is advantageously formed against a further intrusion of printing substance into the cavities of the printing plate.

The intrusion of printing substance into a cavity is limited by the fact that the gas volume in the cavity is compressed by the intrusion of printing substance, whereby the pressure in the gas volume is increased and thereby a force acting on the pressing substance counteracts the further intrusion of printing substance.

The printing substance does not necessarily have to enter into the openings in the printing plate in order to close these in a gas-tight manner. A coherent film or islands of film or individual drops of printing substance may also close openings in a gas-tight manner. In this case, however, the printing material should not contact the printing substance, since printing substance could otherwise get onto the printing material in an uncontrolled manner. Advantageously, a necessary distance between the surface of the printing plate and the surface of the printing material is predetermined by protrusions on the surface of the printing plate. Here, the printing substance is applied onto the printing plate in such a manner that the tips of the protrusions are not covered with printing substance. The maximum quantity of printing substance applied depends on the height of these protrusions. The printing substance is applied such that the tips of these protrusions are not covered with printing substance. Thus, printing substance is present only between the protrusions on the printing plate. This is achieved, for example, by applying a sufficiently small quantity of printing substance onto the printing plate. It is also possible to use a doctor blade to remove printing substance from the protrusions. The protrusions on the printing plate serve as stops for the printing material. A direct contact between the printing substance and the printing material is prevented by the protrusions of the printing plate. The protrusions are provided on the printing plate in sufficient numbers to prevent the printing material from contact with the surface of the printing plate.

The protrusions may be orderly arranged in a pattern on the surface of the printing plate. It is also possible to provide the protrusions in a disorderly random arrangement. A sufficient number of protrusions can be provided per unit area to prevent a direct contact between the printing substance and the printing material.

A particular design of a printing plate with protrusions is a printing plate with a rough surface. In this case the high tips of the rough surface form the protrusions, and printing substance is applied in such quantities as to ensure that a sufficient number of the high tips is not covered with printing substance. With this kind of printing plate, a doctor blade can be used to remove printing substance from high tips.

It is possible that printing substance enters into the cavities of a printing plate with protrusions. Such a printing plate is advantageous in particular if the flowable printing substance is a suspension. It may be provided that the dimensions of the openings in the printing plate and the dimensions of the solid particles in the suspension are selected such that the liquid of the suspension can enter into the cavities or be drawn into the cavities by capillary forces, while the solid particles of the suspension cannot. It is thereby excluded that the solid particles become canted in the openings and clog the same.

The flowable printing substance may be a flowable printing ink for use in the graphics industry.

However, the flowable printing substance may also include or consist of electronic functional materials from which printed electronics can be manufactured using a printing method of the present invention.

The flowable printing substances may be biologically or chemically active substances that are applied on the printing material in a controlled manner using a printing method of the present invention, so as to react thereon with other substances, for example.

A printing plate of the present invention may for example be made of aluminum oxide by anodic oxidation of a thin disc of aluminum.

The cavities may be blind holes, for examples. The diameters of the blind holes may be 400 nm, for example. The depth of the blind holes may be 100 μm, for example.

In a printing plate having a rough surface, where the roughness forms the protrusions of the present invention, the protrusions may have a maximum height of 0.5 μm, for example. The distance between the protrusions may be about 150 μm, for example.

DETAILED DESCRIPTION OF THE EMBODIMENTS

Figure 1:
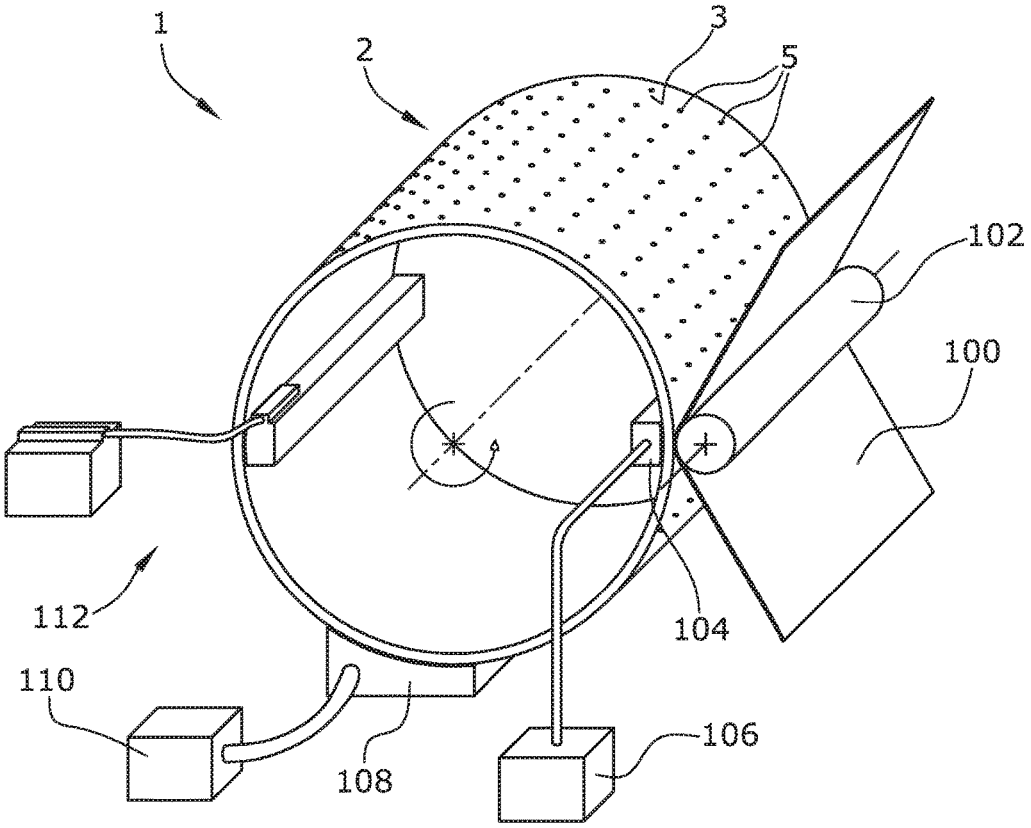
FIG. 1 is a schematic perspective illustration of a printing plate of the present invention.

FIG. 1 schematically illustrates a printing plate 1 of the present invention. In the embodiment illustrated the printing plate 1 is in the form of a hollow cylinder. The printing plate 1 has a body 2 with a surface 3 that has openings 5 that are illustrated only schematically in FIG. 1. As is seen best in FIGS. 2*a* and 2*b* which show the surfaces 3 of two different embodiments of the present invention printing plate in a schematic illustration of a detail, cavities 7 are arranged behind the openings 5, which open into the openings 5. Each cavity 7 ends but in a single opening 5.

The printing plate 1 serves to print on a printing material 100 with a printing substance, which printing material may be pressed against the surface 3 by means of a roller 102, while it is also possible to keep the roller 102 at a defined distance from the surface 3.

The printing roller 1 further comprises a heating apparatus 104 by which gas in the cavities 7 may be heated using individual heating devices. The heating apparatus 104 may be controlled via a control device 106.

The printing substance is applied onto the surface 3 of the printing plate 1 by means of a printing substance application device 108 including an associated printing substance application control device 110. A doctor blade, not illustrated herein, may be provided, for example a doctor knife, by which excess printing substance can be wiped off prior to printing on the printing material.

Further, a cooling device 112 may be provided by which the cavities 7 heated by the heating apparatus 104 can be cooled.

Figure 2A:
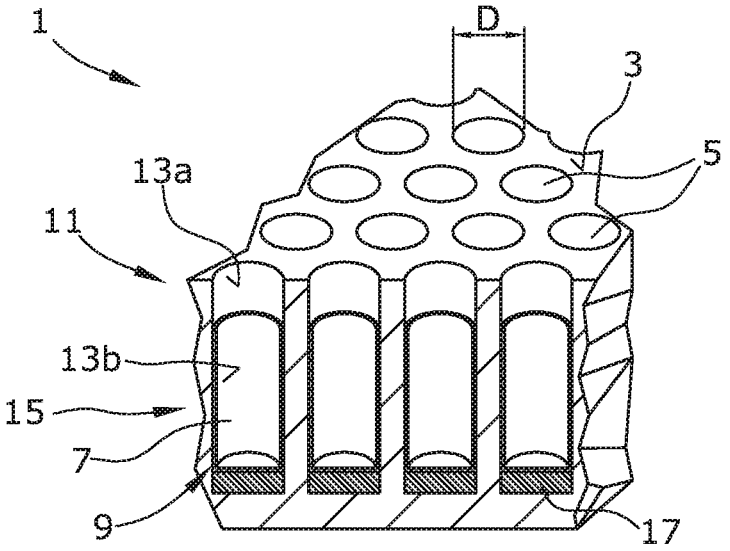
FIGS. 2*a* and 2*b* are schematic illustrations of details of the surface of a printing plate.
Figure 2B:
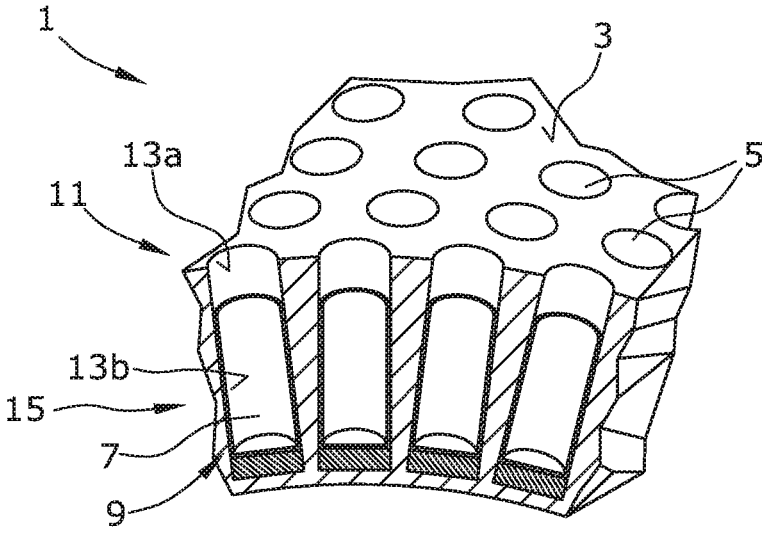

As is best seen in FIGS. 2*a* and 2*b*, the openings are arranged in a raster-like pattern on the surface 3. The cavities 7 opening into the openings 5 are provided as blind holes and are delimited by a wall 9. In a first wall region 11 near the opening, the wall surface 13*a* is designed as a well wettable surface. In a second wall region 15 remote from the opening, the wall surface 13*b* is designed as a surface that is poorly wettable with the printing substance. Further, the openings 5 preferably have a maximum diameter D that is smaller than the capillary length of the printing substance. When the printing substance is applied onto the surface 3, the printing substance is drawn into the cavity 7 by the capillary effect and closes the respective opening 3 in a gas-tight manner.

Due to the gas present in the cavities 7, a counter pressure is built as the printing substance enters into the cavities 7, the counter pressure allowing the printing material to enter only to a certain depth, since the counter pressure of the gas in the cavity 7 counteracts the capillary effect. At the same time or as an alternative, the transition from the well wettable surface of the first wall surface 13*a* to the poorly wettable surface of the second wall surface 13*b* forms a barrier against further intrusion of printing substance.

The embodiments in FIGS. 2*a* and 2*b* only differ in that, in the embodiment in FIG. 2*a*, the surface 3 of the printing plate 1 forms a planar surface, whereas the surface 3 of the embodiment in FIG. 2*b* forms a curved surface.

For printing, the gas in the cavity 7 is heated so that the same expands and generates an overpressure. For the purpose of heating he gas, it is possible to heat end portions 17 of the cavities 7, for example.

FIGS. 3*a*-3*d* schematic detail illustrations of a printing method of the invention.

Figure 3A:
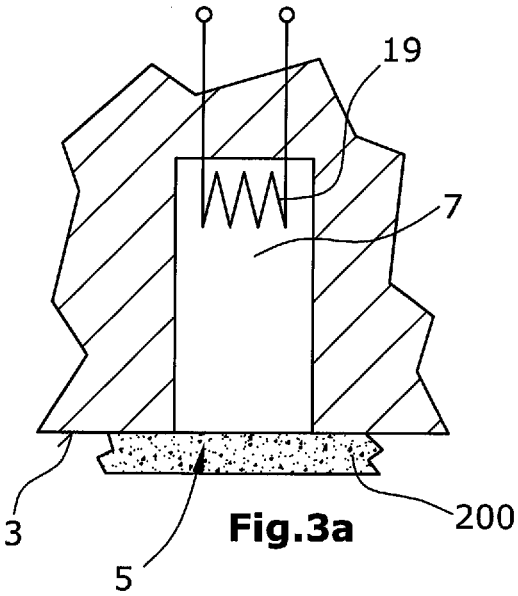
FIGS. 3*a*-3*d* show a schematic illustration of a printing method of the present invention.
Figure 3B:
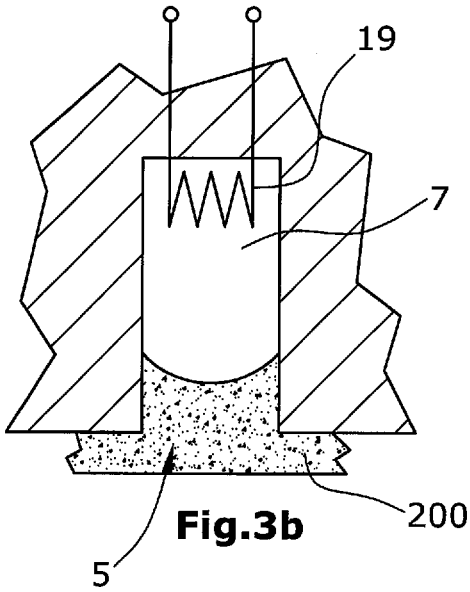
Figure 3C:
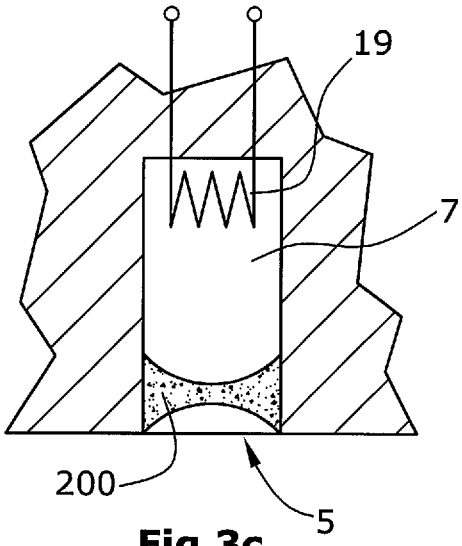
Figure 3D:
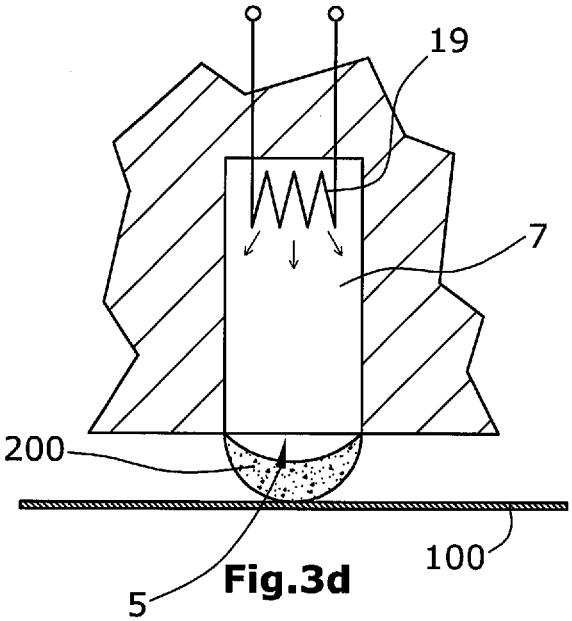

The printing substance 200 is applied onto the surface 3 of a printing plate 1. Due to the capillary forces, the printing substance is drawn through the opening 5 into the cavity 7, with the above described design of the wall surface 13*a* causing the printing substance to remain only in the region near the opening (FIG. 3*b*). Thereafter, the printing substance may be wiped off (FIG. 3*c*). The printing substance 200 closes the opening 5 in a gas-tight manner. By subsequent heating of the gas in the cavity 7 by means of a heating device 19 associated with the cavity 7, an overpressure builds in the cavity 7. Given a sufficiently strong and quick heating of the gas and due to the resulting pressure increase, the printing substance is then forced away from the opening 5, accelerated and, assisted by a commencing gas flow, flung from the cavities 7 onto the printing material 100 (FIG. 3*d*).

A printing method of the present invention using a printing plate 1 of the present invention thus allows a very exact printed image, where it is possible, for example, to selectively heat individual cavities 7 so that a desired printed image is obtained.

In addition or as an alternative to the design of the wall surfaces 13*a*, 13*b*, it is possible to design the surface 3 of the printing plate 1 as a well wettable surface.

With a printing plate 1 of such a design, the surface 3 is wetted with printing substance 200, whereby the openings 5 are closed in a gas-tight manner. In an embodiment, the printing plate 1 in which only the surface 3 is designed as a well wettable surface, all of the printing substance 200 remains on the surface 3 and does not or only slightly enter into the cavities 7 through the openings 5. With a printing plate 1 in which both the surface 3 and the wall surface 13*a* in the wall region 11 near the opening are designed as well wettable surfaces, the printing substance 200 covers the surface 3 and at the same time enters into the cavities 7 through the openings 5.

With a well wettable surface, the contact angle between the printing substance and the surface is less than 90°, preferably less than 45°.

Figure 4:
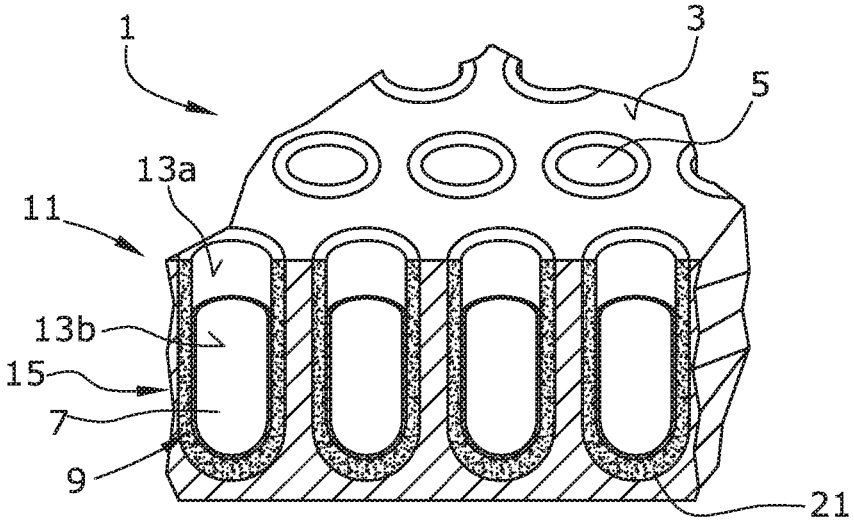
FIG. 4 is a schematic illustration of a detail of another embodiment of the surface of a printing plate.

FIG. 4 is a schematic illustration of a detail of a surface of another embodiment of a printing plate 1 according to the present invention. The embodiment illustrated in FIG. 4 generally corresponds to the embodiment illustrated in FIG. 2*a*. The embodiment differs in that the cavity 7 is surrounded by a sleeve 21. The sleeve 21 is part of the heating device 19, wherein, due to the sleeve 21, it is possible to heat the gas in the cavity 7 in a particularly advantageous and quick manner, since the entire cavity 7 is surrounded by the sleeve 21 so that the gas can be heated almost from all sides.

Figure 5A:
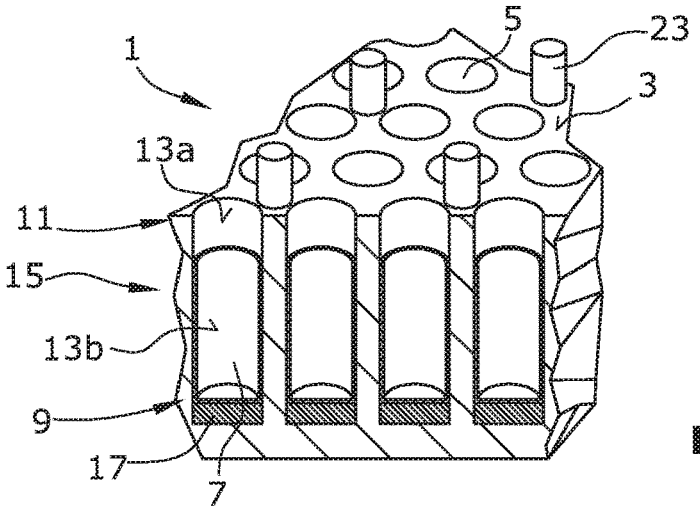
FIGS. 5*a*-5*c* show another embodiment of a printing plate of the present invention with protrusions, as well as a printing method of the present invention.
Figure 5B:
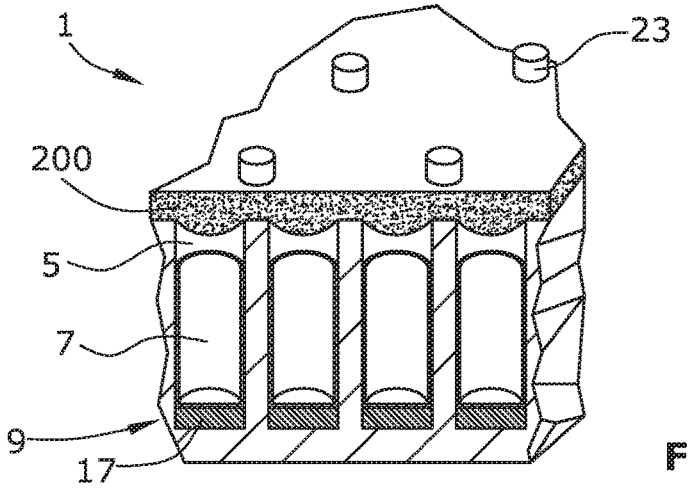
Figure 5C:
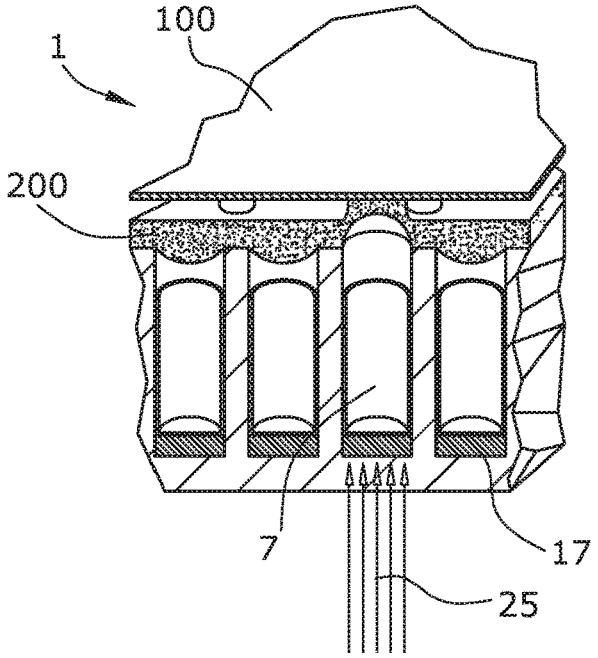

In FIGS. 5*a*-5*c*, a method is illustrated using a printing plate 1 having a surface 3 designed as a surface well wettable with the printing substance 200. Further, also the wall surface 13*a* in the wall region 11 near the opening is designed as a well wettable surface. The printing plate 1 illustrated in FIGS. 5*a*-5*c* generally corresponds to the printing plate 1 illustrated in FIG. 2*a*. It only differs in that the surface 3 is designed as a well wettable surface and that, further, the surface 3 is formed with protrusions 23 acting as spacers for a printing material.

The printing substance 200 is applied on the surface 3 (FIG. 5*b*). Here, printing substance 200 is applied only in such a quantity that the protrusions 23 protrude from the printing substance 200. The printing substance 200 wets the surface 3 of the printing plate 1 and enters in part into the cavities 7 through the openings 5. Thereby, the openings 5 of the cavities 7 are closed in a gas-tight manner.

The protrusions 23 on the surface 3 may be omitted if the distance between the surface 3 and the printed material 100 can be adjusted by an alternative device. For this purpose it is possible to use the roller 102, for example.

As illustrated in FIG. 5*c*, a printing material 100 rests on the protrusions 23 and thus does not contact the printing substance 200 applied on the surface 3. Thereby, a clean printed image is obtained, since the printing substance 200 cannot reach the printing material 100 in an uncontrolled manner. Using a doctor blade, it can be achieved that the ends of the protrusions 23 are free of printing substance.

In selectively chosen cavities 7 or in all cavities 7, the gas in the cavities 7 is heated, whereby overpressure is generated that forces the printing substance 200 out of the cavity 7 and away from the openings and flings it onto the printing material 100. The cavities 7 may be heated, for example, by heating the end portions 17. This may be effected, for example, by means of laser radiation 25 schematically indicated in FIG. 5*c*. The material of the end portion 17 absorbs laser radiation of suitable wavelengths, whereby the end portion is heated.

When laser radiation is used, the wavelength of the laser radiation and the optical properties of the material of the printing plate 1 surrounding the cavities can be selected such that the laser radiation is absorbed primarily by the end portion 17. The end portion 17 may for example include finely dispersed metal inclusions absorbing laser radiation by excitation of plasmons. In this regard it may advantageously be provided that the material of the printing plate does not absorb the laser radiation, whereby the same can be focused on selected end portions 17 through the material so as to heat the gas filling in the relevant cavities 7 in a targeted manner. The sleeves 21 in an embodiment illustrated in FIG. 4 may be heated in a similar manner.

Preferably it is provided that the thermal conductivity of the end portion 17 or of the sleeve 21 is higher than the thermal conductivity of the material of the printing plate 1, whereby the thermal input into the material of the printing plate 1 is reduced when the end portion 17 or the sleeve 21 is heated by the absorbed laser radiation.

Figure 6A:
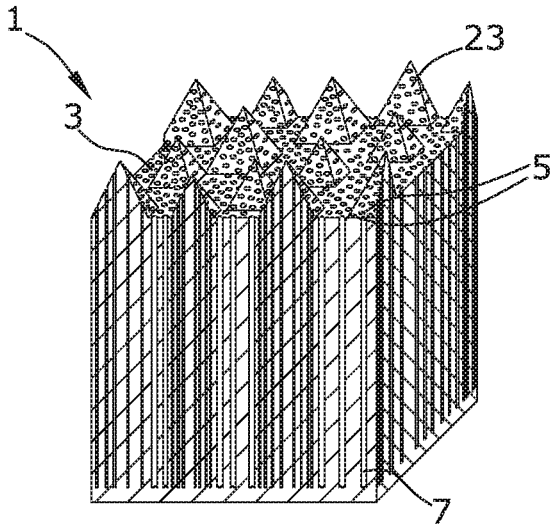
FIGS. 6*a* and 6*b* show another embodiment of a printing plate of the present invention with protrusions on the surface.
Figure 6B:
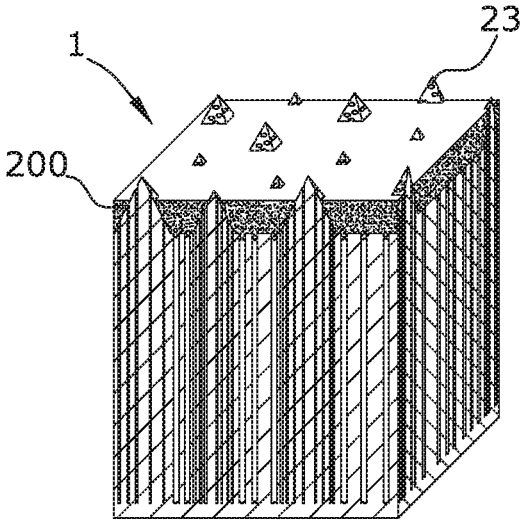

FIGS. 6*a* and 6*b* illustrate another embodiment of a printing plate 1 according to the present invention with protrusions 23. The protrusions 23 are provided on the surface 3 of the printing plate 1 and may differ in size. As in the above described embodiments, the surface 3 of the printing form 1 has openings 5 with adjoining cavities 7. In this printing plate 1, the cavities 7 are formed as blind holes with a large aspect ratio (depth of the blind hole divided by the diameter thereof). This means that the cavity holds a large gas volume that can be heated. Thus, it is possible to fling the printing substance onto the printing material in an advantageous manner, since a strong gas flow can be generated. The protrusions 23 are not arranged uniformly on the surface 3. It is merely necessary to provide a sufficient number of protrusions 23 per unit area to allow them to serve as stops for the printing material 100 and to reliably support the printing material 100. The protrusions 23 are formed by the roughness of the surface 3. Here, the openings 5 are not arranged exclusively in the surface 3 between the protrusions 23, but also in the surface of the protrusions 23 themselves. Thereby, it is possible to form a very fine raster of openings 5, where only small free areas remain that are formed by the tips of the protrusions 23 with which no printing can be performed.

In embodiments illustrated in FIGS. 6*a* and 6*b* the surface 3, as well as the wall surface in the cavities 7 are designed as well wettable surfaces. FIG. 6*b* shows the printing plate of FIG. 6*a* with printing substance 200 applied thereon. This may be achieved, for example, by wiping with a doctor blade. It is thus achieved that a printing material resting thereon cannot get into direct contact with the applied printing substance 200.

Printing plates, such as illustrated in FIGS. 6*a* and 6*b*, may be produced for example in an electrolyte by anodic oxidation of aluminum plates, with the blind holes forming in a matrix of aluminum by self-organization. A printing plate 1 manufactured by this method has cavities in the form of blind holes of a diameter of about 400 nm and a depth of about 100 μm, with the distances between the openings 5 of the blind holes 5 being about 500 nm. Large protrusions 23 have a height of about 0.5 μm and a mean distance between adjacent large protrusions 23 of about 150 μm, for example. In such a printing plate, the bordering of the cavities is made of aluminum oxide enriched in anions which surrounds the cavities in the manner of a sleeve. The matrix of the printing plate surrounding the sleeve is formed by pure aluminum oxide. Laser radiation of a wavelength of 808 nm is absorbed by these sleeves. Using suitable coatings on the wall surfaces of the cavities 7, their properties for wetting with the printing substance can be predetermined, whereby the above described wetting barrier is obtained.

The invention claimed is:

1. A printing plate for transferring a flowable printing substance onto a printing material to be printed on, comprising a body having a surface, which surface has a plurality of openings, a plurality of cavities in the body, which cavities end in the openings of the surface of the body and contain gas, wherein each cavity is bounded by a wall which adjoins the opening and surrounds the respective cavity, and devices associated with each cavity for producing an overpressure in said each cavity, wherein wall surfaces of the walls of at least some cavities include a first wall region near the opening and a first wall surface that can be wetted with the printing substance, wherein, at a second wall region remote from the opening, the wall surfaces of the walls of at least some cavities include a second wall surface less wettable with the printing substance than the first wall surface that can be wetted with the printing substance, and wherein the second wall region adjoins the first wall region.

2. The printing plate of claim 1, wherein, with the printing substance applied on the printing plate, a contact angle between the printing substance and the surface of the body or between the printing substance and the first wall surface in the first wall region of a wall is less than 45°.

3. The printing plate of claim 1, wherein the device for generating an overpressure in a cavity comprises a heating device for heating the gas in the cavity.

4. The printing plate of claim 3, wherein the heating device for heating the gas in the cavity includes a resistance heating element.

5. The printing plate of claim 3, wherein the heating device for heating the gas in the cavity includes an end portion or a sleeve respectively heating up by absorbing electromagnetic radiation.

6. The printing plate of claim 1, wherein protrusions are arranged on the surface to act as spacers for the printing material.

7. The printing plate of claim 6, wherein the protrusions are formed by the roughness of the surface.

8. The printing plate of claim 1, wherein a maximum diameter of the openings is smaller than a capillary length of the printing substance.

9. A method for transferring the flowable printing substance from the printing plate of claim 1 onto the printing material, comprising:

drawing by capillary forces the printing substance into at least a portion of the plurality of cavities into which the openings in the surface of the body open, wherein the printing substance is located in the openings and in regions of the at least a portion of the plurality of cavities near the openings and the printing substance wets the first wall surface that can be wetted with the printing substance, wherein the printing substance closes at least some of the openings in a gas-tight manner, expelling the printing substance from the at least a portion of the plurality of cavities onto the printing material by applying overpressure.

10. The method of claim 9, wherein the printing substance is drawn into the openings and the regions of all cavities of a group of the plurality of cavities, which regions are close to the openings, and the printing substance closes the openings of all cavities of the group of cavities in a gas-tight manner, and the expelling is realized by selectively applying overpressure in selected cavities of the group of cavities.

11. A printing plate for transferring a flowable printing substance onto a printing material to be printed on, comprising a body having a surface, which surface has a plurality of openings, a plurality of cavities in the body, which cavities end in the openings of the surface of the body and contain gas, wherein each cavity is bounded by a wall which adjoins the opening and surrounds the respective cavity, and devices associated with each cavity for producing an overpressure in said each cavity, wherein wall surfaces of the walls of at least some cavities include a first wall region near the opening and a first wall surface that can be wetted with the printing substance, wherein, at a second wall region remote from the opening, the wall surfaces of the walls of at least some cavities include a second wall surface not wettable with the printing substance that forms a contact angle with the printing substance that is larger than 90°, wherein the first wall surface that can be wetted with the printing substance forms a contact angle with the printing substance that is less than 90°, wherein the second wall region adjoins the first wall region.

* * * * *